US006371324B1

(12) United States Patent
Torniainen et al.

(10) Patent No.: US 6,371,324 B1
(45) Date of Patent: Apr. 16, 2002

(54) PORTABLE FOOD CONTAINER COVER WITH DETACHABLE UTENSIL

(75) Inventors: Paul M. Torniainen, Plymouth; John Daugherty, Eden Prairie, both of MN (US); Paul E. Di Mario, Lawrence, MA (US); James Watson, New Lenox; Gregory J. Landis, Palos Park, both of IL (US)

(73) Assignee: General Mills, Inc., Minneapolis, MN (US)

( * ) Notice: Subject to any disclaimer, the term of this patent is extended or adjusted under 35 U.S.C. 154(b) by 0 days.

(21) Appl. No.: 09/249,401

(22) Filed: Feb. 12, 1999

(51) Int. Cl.[7] ..... B65D 41/56

(52) U.S. Cl. ..... 220/212; 206/541; 220/257; 220/258; 220/266; 220/574.1; 220/780; 215/228

(58) Field of Search ..... 220/212, 574, 220/574.1, 212.5, 521, 214, 254, 257, 256, 265, 266, 780, 258; 215/228; 264/328.8, 328.12; 426/106, 112, 115, 122, 123, 131, 124; D7/642, 649, 643, 653; 30/147, 148, 149, 150; 206/217, 223, 541, 542, 229

(56) References Cited

U.S. PATENT DOCUMENTS

| | | | | |
|---|---|---|---|---|
| 1,607,864 | A | | 11/1926 | Butler |
| 1,625,335 | A | | 4/1927 | Schneider |
| 1,657,325 | A | | 1/1928 | Suttle |
| 1,749,658 | A | | 3/1930 | Ault |
| 1,834,085 | A | | 12/1931 | Bloom |
| 2,175,735 | A | | 10/1939 | Banks |
| 2,433,926 | A | | 1/1948 | Sayre |
| 2,789,608 | A | | 4/1957 | Tupper |
| 3,208,625 | A | | 9/1965 | Trabacchi |
| 3,225,915 | A | * | 12/1965 | Wise ..... 215/227 X |
| 3,334,778 | A | | 8/1967 | Saunders |
| 3,381,876 | A | | 5/1968 | Biggins |
| 3,428,099 | A | | 2/1969 | Tenenouser |
| 3,550,805 | A | | 12/1970 | Leonforte |
| 3,623,632 | A | | 11/1971 | Chang |
| 3,624,787 | A | | 11/1971 | Newman |
| 3,679,093 | A | | 7/1972 | Chang |
| 3,704,779 | A | | 12/1972 | Nigg |

(List continued on next page.)

FOREIGN PATENT DOCUMENTS

| | | | | |
|---|---|---|---|---|
| AT | 59647 | | 1/1913 | |
| CN | 96203068.6 | | 11/1997 | |
| DE | 112144 | | 9/1899 | |
| DE | 702295 | C | 2/1941 | |
| DE | 2005 351 | | 8/1971 | |
| FR | 2726535 | * | 5/1996 | |
| LI | CH 665 943 | A5 | 6/1988 | |
| WO | WO 88/08782 | * | 11/1988 | ..... 264/328.12 |

OTHER PUBLICATIONS

A copy of PCT International Search Report mailed on Jul. 17, 2000 (8 pages).

*Primary Examiner*—Allan N. Shoap
*Assistant Examiner*—Robin A. Hylton
(74) *Attorney, Agent, or Firm*—Douglas J. Taylor; Timothy A. Czaja

(57) ABSTRACT

A cover for a portable food container comprising a cover body and a utensil. The utensil includes a head piece and a handle piece. The head piece and the handle piece are each detachably secured to the cover body and are configured for assembly to each other upon detachment from the cover body to form the utensil. In one preferred embodiment, the handle piece includes a reinforcement for limiting longitudinal bending thereof. In an alternative embodiment, the cover further includes a protective film resealably secured to the cover body.

12 Claims, 6 Drawing Sheets

U.S. PATENT DOCUMENTS

| | | | | | |
|---|---|---|---|---|---|
| 3,722,779 | A | | 3/1973 | Chang | |
| 3,730,372 | A | | 5/1973 | Komendowski | |
| 3,925,890 | A | | 12/1975 | Frodsham | |
| 3,931,925 | A | | 1/1976 | Ruff | |
| 3,955,742 | A | | 5/1976 | Marshall et al. | |
| 4,036,398 | A | | 7/1977 | Hoogvelt et al. | |
| 4,060,176 | A | | 11/1977 | Tobiasson | |
| 4,216,875 | A | | 8/1980 | Stanish | |
| 4,218,010 | A | | 8/1980 | Ruff | |
| 4,393,988 | A | | 7/1983 | Burke | |
| 4,524,512 | A | * | 6/1985 | Formo et al. | 30/147 |
| 4,589,204 | A | | 5/1986 | Vogel | |
| 4,615,120 | A | | 10/1986 | Newman | |
| 4,930,637 | A | | 6/1990 | DeRoseau | |
| D309,845 | S | | 8/1990 | Pozzi | |
| 5,090,572 | A | | 2/1992 | DeRoseau | |
| 5,167,973 | A | | 12/1992 | Snyder | |
| 5,188,234 | A | | 2/1993 | Fukuda et al. | |
| 5,197,623 | A | | 3/1993 | Wang | |
| 5,222,622 | A | | 6/1993 | Laske, Jr. | |
| 5,241,835 | A | | 9/1993 | Ascone | |
| 5,251,758 | A | | 10/1993 | Kolacek | |
| 5,251,774 | A | | 10/1993 | Engle | |
| 5,261,560 | A | | 11/1993 | Wang | |
| 5,415,309 | A | | 5/1995 | Wang | |
| 5,443,174 | A | | 8/1995 | Bauer | |
| D362,160 | S | * | 9/1995 | Brabeck et al. | D7/645 |
| 5,491,897 | A | | 2/1996 | Michelena | |
| 5,587,192 | A | * | 12/1996 | Beizermann | 220/360 X |
| 5,657,802 | A | * | 8/1997 | Kim | 220/212 X |
| 5,695,084 | A | | 12/1997 | Chmela et al. | |
| 5,705,212 | A | | 1/1998 | Atkinson | |
| 5,992,667 | A | * | 11/1999 | Huang | 220/212 |
| 6,003,710 | A | | 12/1999 | Huang | |

* cited by examiner

PORTABLE FOOD CONTAINER COVER WITH DETACHABLE UTENSIL

BACKGROUND OF THE INVENTION

The present invention relates to a cover for a portable food container. More particularly, it relates to a cover incorporating a detachable utensil, the cover designed for improved performance and cost effective mass production.

A variety of different of snack food and/or drink products are packaged in relatively small, single serving containers. For example, yogurt, pudding, soup, etc. are all available in single serving packages. Consumers have expressed a strong interest in the convenience presented by this packaging technique. Namely, with a small, single serving package, the consumer is able to easily transfer the packaged food from one location (e.g., home) for consumption at another location (e.g., work, outdoor event, etc.).

Many of the available single serving food products are consumable without the use of a separate eating utensil. For example, relatively solid snack food items, such as cheese sticks and candy bars, can be eaten by hand. Similarly, drink products, such as soda pop and fruit drinks, are typically consumed directly from the package or container, without the need for an eating utensil.

A third category of consumable snack items relates to semi-liquid items such as yogurt, cottage cheese, oatmeal, etc., or food items that are normally eaten hot or cold such as soup or ice cream. Consumption of these types of food normally requires a spoon, fork or similar utensil. In other words, the relatively liquid snack food items are not solid enough to be grasped by the consumer's hand, and have too high a viscosity to be drunken. Soups frequently contain solid pieces dispersed in a liquid broth. Along these same lines, the containers associated with semi-liquid food items are normally rigid and therefore do not facilitate direct consumption. Alternatively, it may be difficult for a consumer to handle directly a frozen food item or an item that is served hot. In still other food applications, foods may require mixing for best use prior to consumption. For example, "Sundae" style yogurt contains a layer of fruit sauce that is desirably mixed with the yogurt prior to consumption.

In light of the above, consumers are normally required to provide their own eating utensil to consume a single serving container of semi-liquid or temperature sensitive food. Occasionally, however, the consumer may not have ready access to such a utensil. For example, a consumer may desire to consume a single serving container of yogurt at a park. If the consumer forgets to bring a spoon with him or her, it is quite likely that the yogurt will not be consumed. The resulting frustration may dissuade that same consumer from purchasing the product again in the future. Similarly, a potential purchaser may decide against initially trying a particular product due to a perceived inconvenience in consumption. Obviously, these lost sales opportunities are of great concern to food product manufacturers. As such, any efforts to alleviate the consumption problem associated with semi-liquid food and/or temperature sensitive items will likely provide the particular food product manufacturer with a distinct competitive advantage.

One possible solution to the above-described problem is to provide an eating utensil with the product packaging. As a point of reference, one generally accepted snack food packaging approach entails an open-ended container and an associated lid or cover. A food item is maintained within the container. The cover normally seals the open end of the container, but is removable so as to provide access to the food. With this in mind, attempts have been made to incorporate an eating utensil into the packaging configuration. U.S. Pat. No. 5,705,212, for example, describes a food package having a foldable spoon disposed in a storage compartment formed underneath the cover. While this approach does directly provide the consumer with an eating utensil, it is likely not a viable solution from a cost standpoint. In terms of mass production, the increased packaging expense associated with providing a separate spoon element, in conjunction with the additional manufacturing steps of locating the spoon within a small compartment, likely renders this design cost prohibitive. Alternatively, other efforts have been made to integrally form a detachable spoon or other utensil into the cover. While this approach is more cost effective, certain other issues remain. For example, the integrally formed utensil may fail during normal use where the spoon does not have sufficient rigidity. Additionally, it may be difficult, if not impossible, to reseal the cover to the container once the spoon has been removed therefrom. Conversely, even a slight increase in spoon thickness to improve performance may result in an unacceptable increase in overall production costs. Other unforeseen manufacturing and design concerns will likewise increase the production costs and cycle time, potentially beyond a cost effective level.

Consumers continue to demand snack food items packaged in convenient, single serving containers. However, for certain types of food, the requirement of a separate eating utensil may diminish purchasing enthusiasm. Therefore, a substantial need exists for a portable food container cover having a detachable utensil with optimized performance and manufacturing characteristics.

SUMMARY OF THE INVENTION

One aspect of the present invention provides a cover for a portable food container. The portable food container includes a base and a side wall terminating in a lip opposite the base. With this in mind, the cover comprises a cover body and a utensil. The cover body is configured to selectively receive the lip formed by the container. The utensil includes a head piece and a handle piece. The head piece is detachably secured to the cover body. Similarly, the handle piece is detachably secured to the cover body. Further, at least a portion of the handle piece includes a reinforcement for limiting longitudinal bending of the handle piece. Finally, the head piece and the handle piece are configured for assembly to each other upon detachment from the cover body. In this assembled position, the head piece and the handle piece combine to form the utensil. In one preferred embodiment, the head piece includes a bowl such that the assembled utensil is a spoon. Prior to use by a consumer, the cover is secured to the container via the cover body. When the consumer is ready to consume the contents of the container, the cover is removed from the container. The head piece and the handle piece are detached from the cover body and assembled to form the utensil. The utensil, in turn, is then used by the consumer to consume food maintained in the container. In this regard, the reinforcement limits bending of the handle piece to reduce the potential for disassembly of the handle piece from the head piece during use.

Another aspect of the present invention relates to a cover for a portable food container. The portable food container includes a base and a side wall terminating in a lip opposite the base. With this in mind, the cover comprises a cover body, a head piece, a handle piece and a plurality of breakable tabs. The cover body includes a face member and a skirt extending from an outer periphery of the face member. The face member forms a head opening and a handle opening. The skirt, in turn, is sized to selectively receive the lip formed by the container. The head piece is disposed within the head opening and includes a leading end and a trailing end. Similarly, the handle piece is disposed within the handle opening of the face member and includes a leading end and a trailing end. The plurality of breakable tabs detachably secure the head piece and the handle piece, respectively, to the face member. In this regard, individual ones of the breakable tabs are located to connect both the leading end and the trailing end of the bead piece to the face member. Likewise, separate breakable tabs are positioned so as to connect both the leading end and the trailing end of the handle piece to the face member. Finally, the head piece and the handle piece are configured for assembly to each other upon detachment from the face member to form a utensil. In one preferred embodiment, the head piece includes a bowl such that the assembled utensil is a spoon.

Yet another aspect of the present invention relates to a cover for a portable food container defined by a base and a side wall forming a lip. The cover comprises a cover body, a head piece, a handle piece and a plurality of gate markings. The cover body includes a face member and a skirt. The skirt extends from an outer periphery of the face member and is sized to selectively receive the lip. The head piece and the handle piece are each detachably secured to the face member. Further, the head piece and the handle piece are configured for assembly to each other upon detachment from the face member to form a utensil. In one preferred embodiment, the head piece includes a bowl such that the assembled utensil is a spoon. Finally, the plurality of gate markings is indicative of a plurality of plastic injection gates. Thus, the cover is formed by a device incorporating a plurality of plastic injection gates that result in the plurality of gate markings.

Yet another aspect of the present invention relates to a cover for a portable food container defined by a base and a side wall forming a lip. The cover comprises a cover body, a head piece and a handle piece. The cover body includes a face member and a skirt. The skirt extends downwardly from an outer periphery of the face member such that the face member defines an upper most plane of the cover. The head piece and the handle piece are detachably secured to the face member. Further, the head piece and the handle piece are configured for assembly to each other upon detachment from the face member to form a utensil. In one preferred embodiment, the head piece includes a bowl such that the assembled utensil is a spoon.

Yet another aspect of the present invention relates to a cover for a portable food container. The portable food container includes a base and a side wall terminating in a lip opposite the base. The cover comprises a cover body, a utensil and a protective film. The cover body includes a face member and a skirt. The skirt extends from an outer periphery of the face member and is sized to selectively receive the lip formed by the container. The utensil is formed in the cover body and includes a head piece and a handle piece. Each of the head piece and the handle piece are detachably secured to the face member. Further, the head piece and the handle piece are configured for assembly to each other upon detachment from the cover body to form the utensil. In one preferred embodiment, the head piece includes a bowl such that the assembled utensil is a spoon. Finally, the protective film is resealably secured to the cover body. Tile protective film provides a sanitary seal for the head piece and the handle piece. Prior to use, the cover is mounted to the container via the skirt. To access the contents of the container, a consumer simply removes the cover from the container. Once removed, the head piece and the handle piece are detached from the face member and assembled to form a utensil. As part of this detachment process, or for other reasons, the protective film may partially disengage the cover body. However, the protective film can be resealed to the cover body and the cover body resecured to the container so as to protect any remaining food contents.

Yet another aspect of the present invention provides a cover for a portable food container defined by a side wall forming a lip. The cover comprises a cover body, a utensil, a plurality of breakable tabs, a plurality of gate markings and a protective film. The cover body includes a face member and a skirt. The face member forms a head opening and a handle opening. The skirt extends downwardly from an outer periphery of the face member such that the face member defines an upper most plane of the cover body. Further, the skirt is configured to selectively receive the lip formed by the container. The utensil includes a head piece and a handle piece. The head piece is disposed within the bowl opening and defines a leading end and a trailing end. Several of the plurality of breakable tabs detachably connect the head piece to the face member, including the leading end and the trailing end. The handle piece is disposed within the handle opening and defines a leading end and a trailing end. Several of the plurality of breakable tabs detachably connect the handle piece to the face member, including the leading end and the trailing end. Upon detachment from the face member, the head piece and the handle piece are configured for assembly to each other to form the utensil. In one preferred embodiment, he head piece includes a bowl such that the assembled utensil is a spoon. The plurality of gate markings is indicative of a plurality of injection mold gates. Finally, the protective film is resealably secured to the cover body.

Yet another aspect of the present invention relates to a method of manufacturing a cover for a portable food container. The cover includes a cover body and a utensil detachably connected to the cover body, the utensil including a head piece and a handle piece. The method of manufacturing includes providing a mold configured to produce a portable food container cover having a desired shape and size, and including a detachable utensil. A plurality of gates are formed in the mold. A flowable plastic is injected into the mold via the plurality of gates to form the portable food container cover. Finally, the portable food container cover is removed from the mold. By employing a plurality of gates, the above process greatly reduces the overall costs of manufacture.

DETAILED DESCRIPTION OF THE PREFERRED EMBODIMENTS

Figure 1:
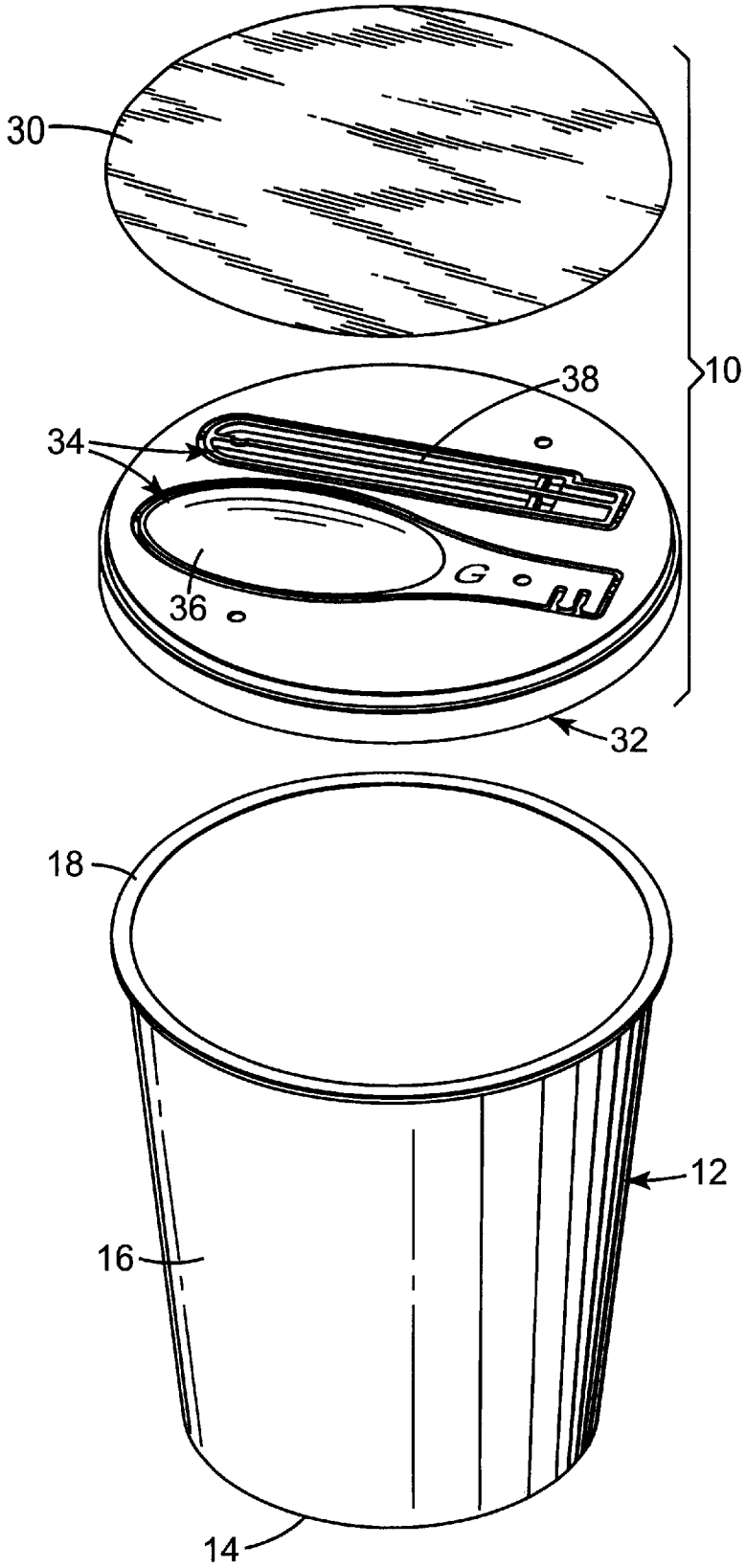
FIG. 1 is a perspective, exploded view of a cover in accordance with the present invention, shown in conjunction with a portable food container.

One preferred embodiment of a cover 10 is shown in FIG. 1. As a point of reference, the cover 10 is shown in conjunction with a portable food container 12. Disposed within the container 12 is a food item such as yogurt (not shown). The container 12 includes a base 14 and a side wall 16. The side wall 16 extends from the base 14 and forms a lip 18 at an open end opposite the base 14. In general terms, the container 12 is sized to be portable, preferably maintaining a single serving or multiple servings of food. Because the container 12 is in direct contact with food, a material approved for food contact should be employed, as is well known in the art. The skilled artisan will appreciate that in other variations, containers 12 can be fabricated wherein the base 14 and the side wall 16 are integrally formed. The side wall 16 is depicted in FIG. 1 as being frusto conically shaped. Alternatively, the side wall 16 can be any of a number of different shapes, including cylindrical, rectangular, square, etc. The side wall 16 can be continuous as depicted or formed of separated pieces.

In one preferred embodiment, the cover 10 includes a protective film 30, a cover body 32 and a utensil (shown generally at 34). As described in greater detail below, the cover body 32 is configured to be releasably secure to the lip 18 formed in the container 12. The utensil 34 includes a head piece 36 and a handle piece 38, each of which are detachably secured to the cover body 32. In one preferred embodiment, the utensil 34 is a spoon, with the head piece 36 configured as a bowl piece. As described below, however, the utensil 34 may assume a wide variety of forms, including a fork, spork (i.e., a combined fork and spoon) or knife. Finally, the protective film 30 is resealably secured to the cover body 34.

One function of the protective film 30 is to provide a sanitary seal for the head piece 36 and the handle piece 38, and is preferably shaped in accordance with the cover body 32. Thus, in the embodiment shown in FIG. 1, where the cover body 32 is generally circular, the protective film 30 is likewise circular in shape. While a wide variety of film materials may be used for the protective film 30, the material selected preferably exhibits a high degree of clarity, such as that found with polystyrene (PS). To this end, PS facilitates rapid manufacture in that PS is relatively stiff and is therefore readily removable from a backing material. It should be noted, however, that any other similar polymer-type film may be employed. To this end, the protective film 30 need not necessarily be clear but may be tinted, translucent or even opaque. Additionally., the protective film 30 may include indicia (not shown), such as a manufacturer trademark or trade name, product description, etc. Finally, while the protective film 30 does serve to protect the utensil 34 from contamination, the protective film 30 is not a necessary element of the present invention. In other words, the cover 10 will function without the protective film 30. A second function of the protective film is to provide the cover 10 with a reclosure feature for when only a portion of the food contents is consumed.

Figure 2A:
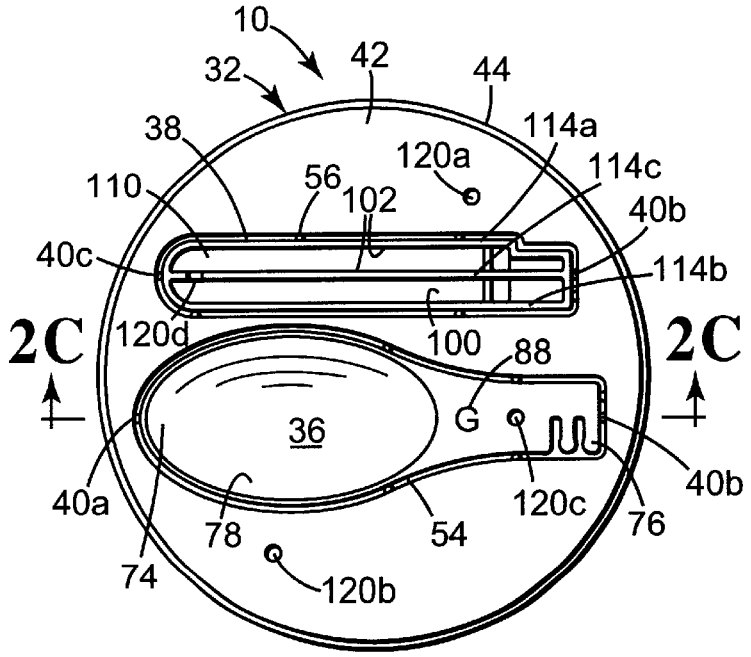
FIG. 2A is a top, elevational view of the cover of FIG. 1 in accordance with the present invention.
Figure 2B:
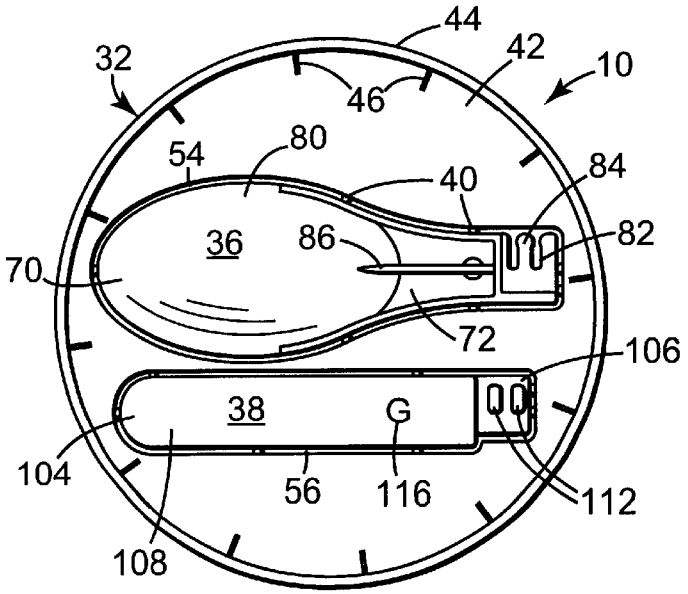
FIG. 2B is a bottom, elevational view of the cover of FIG. 1 in accordance with the present invention.
Figure 2C:
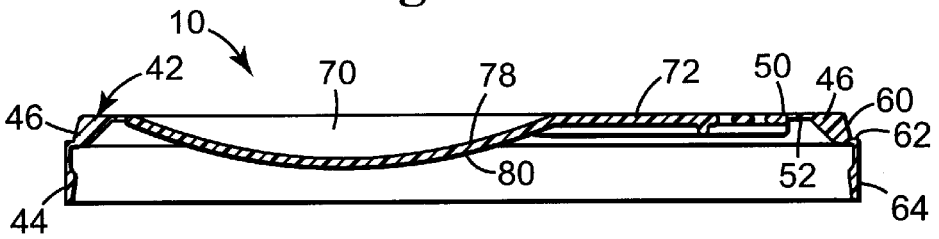
FIG. 2C is an enlarged, cross-sectional view of the cover of FIG. 2A, along the line 2C—2C.

The cover 10 is shown in greater detail in FIGS. 2A–2C. For purposes of illustration, the cover 10 is depicted in FIGS. 2A–2C with the protective film 30 (FIG. 1) removed. The cover 10 shown in FIGS. 2A–2C includes the cover body 32, the head piece 36, and the handle piece 38 each detachably secured to the cover body 32 by a plurality of breakable tabs 40.

The cover body 32 preferably includes a face member or portion 42, a downwardly extending skirt 44 and a plurality of spaced apart support runners or ribs 46 (FIG. 2B). Further, as best shown in FIG. 2B, each of the plurality of support runners 46 project radially inwardly from the skirt 44 along the face member 42.

The face member 42 is preferably substantially planar, defining a top surface 50 and a bottom surface 52. Further, the face member 42 is fabricated to include a head opening 54 and a handle opening 56. The shape of the head opening 54 corresponds with, and is slightly larger than, a shape of the head piece 36; whereas the handle opening 56 is shaped in accordance with, and is slightly larger than, a shape of the handle piece 38. In one preferred embodiment, the face member 42 is circular corresponding with the container 12 (FIG. 1), although any other shape is acceptable. In a preferred embodiment, and as shown most clearly in FIGS. 2A and 2B, the head opening 54 and the handle opening 56 are entirely closed relative to the skirt 44. In other words, the face member 42 preferably includes material between the entire periphery of each of the head opening 54 and the handle opening 56, and the skirt 44.

As best shown in FIG. 2C, the downwardly extending skirt 44 includes a first section 60, a shoulder or ridge 62 and a second section 64. The first section 60 projects from the face member 42 and is connected to the second section 64 by the ridge 62. In this regard, the first section 60 has a diameter less than a diameter of the second section 64 such that the ridge 62 extends radially outwardly from the first section 60 to the second section 64. With this preferred configuration, a second, similarly constructed cover body (not shown) can be stacked on top of the cover body 32, with the skirt portion of the second cover body nesting against the ridge 62. Finally, the second section 64 is configured to releasably engage the lip 18 (FIG. 1) of the container 12 (FIG. 1). To this end, the second section 64 preferably forms an annular groove 66 that is sized to engage the lip 18.

The plurality of support runners 46 are provided to assist in proper assembly of the cover body 32 to the container 12 (FIG. 1), as well as to facilitate a more rigid interface between the two components. In this regard, each of the plurality of support runners 46 terminate at the annular groove 66 in the skirt 44 and are preferably uniformly spaced about the circumference of the bottom surface 52 of the face member 42. By uniformly spacing the plurality of support runners 46, a relatively uniform force distribution across the cover body 32 can be achieved, although a slight deviation to this preferred uniform spacing is acceptable. As best shown in FIG. 2B, formation of the bowl opening 54 and/or the handle opening 56 may limit an allowable length of one or more of the plurality of support runners 46. Preferably, however, each of the support runners 46 has a substantially similar size. So that the plurality of support runners 46 do not overly diminish flexibility of the cover body 32, a ratio of a diameter of the cover body 32 to a length of each of the plurality of support runners 46 is preferably greater than approximately 15:1; more preferably 20:1, although other dimensions are equally acceptable. For example, where the cover body 32 has a diameter of 80 mm, each of the plurality of support runners 46 will preferably have a length of approximately 4 mm. Notably, by incorporating the plurality of support runners 46 as opposed to a continuous strip of material, the total amount of material required for the cover body 32, and thus the per unit cost, is greatly reduced. However, an adequate number of support runners 46 are required to sufficiently support the cover body 32 relative to the container 12. In this regard, preferably at least nine support runners 46 are provided; most preferably twelve support runners 46.

Still referring to FIGS. 2A–2C, the head piece 36 is sized to be disposed within the head opening 54 and includes a food retaining means 70 and a neck 72. In one preferred embodiment, as shown in FIGS. 2A–2C, the utensil 34 is a spoon. With that preferred design, the head piece 36 is a bowl piece such that the food retaining means 70 is a bowl. Alternatively, the food retaining means 70 may be fork tines, a knife blade, a spork body, etc. The food retaining means 70 and the neck 72 are preferably integrally formed and combine to define a leading end 74, a trailing end 76, a top surface 78 and a bottom surface 80 of the head piece 36. Importantly, the terms "top surface" and "bottom surface" are with reference to a desired orientation of the head piece 36 upon removal from the face member 42 and assembly to the handle piece 38, as described in greater detail below. This direction terminology does not limit orientation of the head piece 36 relative to the face member 42. The trailing end 76 forms a coupling means, preferably including a pair of slots 82 separated by a finger 84. Finally, as best shown in FIG. 2B, the head piece 36 preferably includes a reinforcement 86 and an indicia 88. The reinforcement 86 is, in one preferred embodiment, a centrally disposed rib extending in a longitudinal fashion along the bottom surface 80 from the neck 72 to the food retaining means (or bowl) 70. The reinforcement 86 is provided to limit longitudinal bending of the head piece 36. The indicia 88 is preferably inscribed on the top surface 78 of the head piece 36 and, as described below, is provided to assist a user (not shown) in properly orienting the head piece 36 relative to the handle piece 38 upon detachment from the face member 42. In one preferred embodiment, for example, the indicia 88 is a trademark.

In one preferred embodiment, the head piece 36 has a length (from the leading end 74 to the trailing end 76) greater than 6.0 centimeters, more preferably greater than 6.5 centimeters, although other dimensions are equally acceptable. Further, the head piece 36 is preferably sized to provide sufficient surface area for a user to retrieve and transfer food, while also establishing an appropriate overall length. Thus, in one preferred embodiment, where the head piece 36 is configured to include a bowl, the neck 72 has a length greater than one-third a length of the bowl 70.

The handle piece 38 is preferably sized to be disposed within the handle opening 56 in the face member 42, and includes a base portion 100 and a reinforcement 102. The base portion 100 defines a leading end 104, a trailing end 106, a top surface 108 and a bottom surface 110. A coupling means is preferably formed at the trailing end 106 and, in one preferred embodiment, includes a pair of posts 112. Importantly, the terms "top surface" and "bottom surface" are with reference to a desired orientation of the handle piece 38 upon removal from the face member 42 and assembly to the head piece 36, as described below. This directional terminology does not limit possible orientation of the handle piece 38 relative to the face member 42. In other words, as shown in FIGS. 2A–2C, the top surface 108 of the handle piece 38 may be adjacent the bottom surface 52 of the face member 42; whereas the bottom surface 110 of the handle piece 38 is adjacent the top surface 50 of the face member 42.

In one preferred embodiment, the reinforcement 102 of the handle piece 38 includes a plurality of ribs **114*a*–114*c*. As best shown in FIG. 2A, each of the plurality of ribs 114*a*–114*c* extend in longitudinal fashion along the base portion 100. In one preferred embodiment, three of the ribs 114*a*–114*c* are provided; with two of the ribs 114*a*, 114*b* positioned at opposite sides of the base portion 100, respectively, and a third rib 114*c* centrally located relative to the base portion 100. Alternatively, any other number of ribs may be employed. For example, only the central rib 114*c* may be included. Regardless of the exact number, the plurality of ribs 114*a*–114*c* serve to limit longitudinal bending of the handle piece 38. In light of this strengthening characteristic, the amount or thickness of the base portion 100 can be reduced, thereby reducing the per unit cost while increasing overall stiffness. With this in mind, it is preferred that the ribs 114*a*–114*c* have a thickness greater than a thickness of the base portion 100. For example, in one preferred embodiment, the base portion 100 has a thickness of approximately 0.04 inch (≈1 mm), whereas each of the ribs 114*a*–114*c* has a thickness (or extension from the base portion 100) of 0.07 inch (≈2 mm). On a mass production basis, this presents a substantial savings over a handle piece comprised solely of a base portion having a thickness of 0.1 inch (≈2.5 mm). Pointedly, a so-constructed handle piece 38 has been shown to be approximately 25% stiffer (per unit length) than a handle piece having a base portion of 0.07 inch thickness and no reinforcement, while using approximately 15% less plastic (per unit length). Obviously, other dimensional characteristics are acceptable, as are other configurations for the reinforcement 102. For example, the reinforcement 102** may be an angularly extending rib, a small block of material, etc.

In one preferred embodiment, the handle piece 38 further includes indicia 116 inscribed along the top surface 108. The indicia 116 can visually or tactually assist a user (not shown) in properly orientating the handle piece 38 relative to the head piece 36 upon detachment from the cover body 32. In one preferred embodiment, the indicia 116 is a trademark or trade name. Alternatively, other letters, numbers or symbols may be used. Even further, the indicia 116 may be eliminated entirely.

The handle piece, in one preferred embodiment, has a length (from the leading end 104 to the trailing end 106) greater than 5.5 centimeters, more preferably at least 6.0 centimeters, although other dimensions are acceptable.

The head piece 36 and the handle piece 38, respectively, are detachably secured to the face member 42 by the plurality of breakable tabs 40. As shown in FIGS. 2A and 2B, the plurality of tabs 46 extend from various locations along the outer periphery of both the head piece 36 and the handle piece 38. In a preferred embodiment, the plurality of tabs 40 are located to provide relatively uniform support to the head piece 36 and the handle piece 38, respectively. For example, tabs 40 are provided not only along sides of the head piece 36, but also at least one of the tabs **40*a* connects the leading end 74 of the head piece 36 to the face member 42, and at least another one of the tabs 40*b* connects the trailing end 76 to the face member 42. Similarly, at least one of the tabs 40*c* is positioned to connect the leading end 104 of the handle piece 38 to the face member 42, and another one of the tabs 40*d* connects the trailing end 106 to the face member 42. It should be understood that more than one tab 40 may be provided to connect the respective leading ends 74, 104 and trailing ends 76, 106 to the face member 42**.

In one preferred embodiment, the cover body 32, the head piece 36, the handle piece 38 and the breakable tabs 40 are integrally formed from a plastic material. For example, a polypropylene material may be used. Alternatively, any other relatively rigid polymer that is preferably conducive to injection molding may be useful. Preferably, however, the selected material is approved for contact with food.

One preferred method of integrally forming the cover body 32, the head piece 36, the handle piece 38 and the plurality of breakable tabs 40 is plastic injection molding. To this end, FIG. 2A depicts a plurality of gate markings 120*a*–120*d* in the cover 10. The plurality of gate markings 120*a*–120*d* are indicative of a manufacturing process in which a mold is provided with a plurality of gates. In one preferred embodiment, four gates, and therefore four gate markings 120*a*–120*d*, are provided. By utilizing a plurality of gates, as opposed to a single gate, the cycle time required to produce the cover 10 is greatly reduced. For example, it has been found that a production capacity for a four gate mold is approximately six times greater than a single gate mold. As shown in FIG. 2A, the plurality of gate markings 120*a*–120*d*, and therefore the plurality of gates used in conjunction with the mold used to produce the cover 10, are balanced to facilitate a relatively uniform plastic flow. To this end, the mold may be definable by a cover body section for forming the cover body 32; a head section for forming the head piece 36 and a handle section for forming the handle piece 38. With this construction in mind, the gate marking 120*a* and the gate marking 120*b* are positioned at opposite sides of the face member 42. A third one of the gate markings 120*c* is positioned in the head piece 36, whereas a fourth one of the gate markings 120*d* is located within the handle piece 38. Alternatively, any other number and location of gate markings, and therefore gates, may be used. For example, one or all of the gate markings 120*a*–120*d* may formed on the bottom surface 52 of the face member 42. In addition to reducing fabrication cycle time, utilization of a plurality of gates also can aid in provision of highly uniformly shaped lid elements.

Following manufacture of the cover body 32, the head piece 36, the handle piece 38 and the breakable tabs 40, the protective film 30 (FIG. 1) is secured to the cover body 32. In one preferred embodiment, the protective film is secured to the face member 42. To effectuate a more complete engagement between the face member 42 and the protective film 30, the face member 42, and in particular the top surface 50, defines an upper most surface for receiving the protective film 30. In other words, the skirt 44, the head piece 36 and the handle piece 38 do not project above a plane of the top surface 50. Further, in one preferred embodiment, the face member 42 encloses each of the head opening 54 and the handle opening 56 relative to the skirt 44 such that a continuous engagement surface is provided. The top surface 50 of the face member 42, the top surface 78 of the head piece 36 and the ribs 114*a*–114*c* of the handle piece 38 may all be the same plane, such that at least a portion of the head piece 36 and the handle piece 38 receive the protective film 30. However, it is preferred that the head piece 36 and the handle piece 38 do not extend above the top surface 50 of the face member 42. For example, where the head piece 36 includes a bowl (the food retaining means 70 in FIG. 2C), the head piece 36 is orientated relative to the face member 42 such that the convex extension of the bowl 70 projects downwardly below the top surface 50. By mounting the protective film 30 to the face member 42 instead of an annular shoulder or similar body, a more complete engagement is achieved. Thus, the face member 42 provides a relatively large bonding area for receiving the protective film 30. As a result, a more complete engagement between the protective film 30 and the cover body 32 is achieved.

In one preferred embodiment, the protective film 30 is secured to the face member 42 via a pressure sensitive adhesive. For example, a hot melt adhesive such Aromelt®, available from Ashland Chemical, may be used. Alternatively, any other hot melt adhesive or other type of adhesive may be useful. Preferably, however, the selected adhesive conforms with applicable national standards (such as in U.S.A. 21 Code of Federal Regulations 175.125) relating to materials in direct or indirect contact with various foods. Importantly, the particular adhesive employed preferably allows for repeated partial or full removal and resealing of the protective film 30 to the face member 42. In other words, the protective film 30 may be partially or completely peeled away from the face member 42, and then later resealed. To this end, the selective adhesive preferably has a bond strength that allows for partial or full removal of the protective film 30 by a user (not shown).

Figure 3:
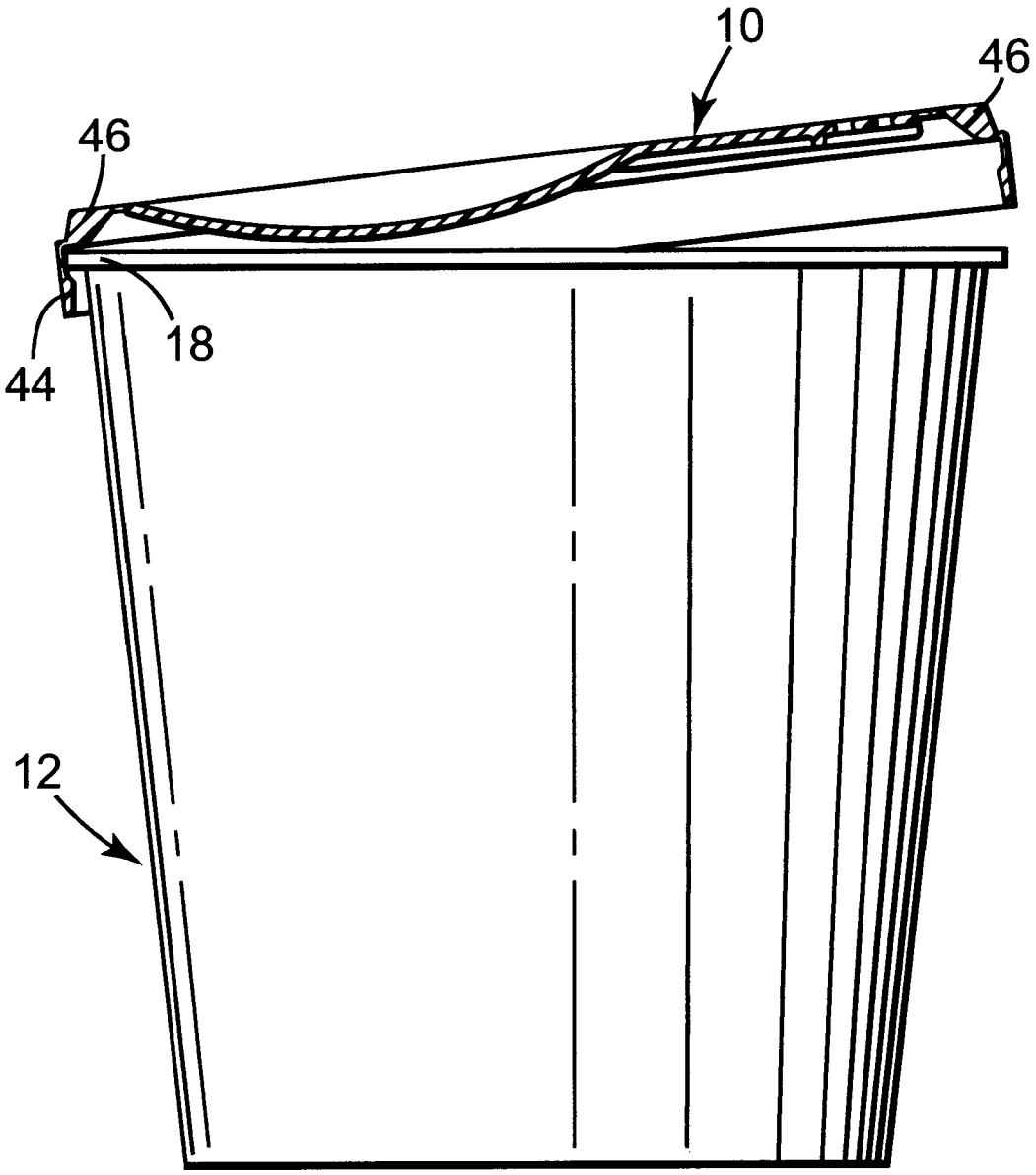
FIG. 3 is a cross-sectional view of the cover in accordance with the present invention, partially assembled to a portable food container.

Once the cover 10, including the protective film 30, is complete, the cover 10 may then be assembled to the container 12 as shown in FIG. 3. With one preferred mass production technique, the cover 10 is located above the container 12 and positioned at a slight angle. More particularly, the cover 10 is maneuvered toward the container 12 such that a portion of the skirt 44 passes over the lip 18 of the container 12. This motion is continued until one of the plurality of support runners 46 contacts the lip 18. Because, as previously described, the plurality of support runners 46 are uniformly spaced about the outer circumference of the face member 42, regardless of the exact rotational position of the cover 10 relative to the machine arm, at least one of the plurality of support runners 46 will contact the lip 18, thereby preventing damage to the cover 10. As the cover 10 is directed into complete engagement with the lip 18 (FIG. 4) such as with a mechanical roller, the plurality of support runners 46 direct deflection of the skirt 44 such that the lip 18 nests within the annular groove 66 (FIG. 2C).

Following complete assembly of the cover 10 to the container 12 (as shown in FIG. 14), the product may be maneuvered to a separate location. For example, the assembled cover 10/container 12 may be placed within a larger package having a number of similar products. To this end, a pick-and-place handling device including a machine arm (not shown) having a suction cup (not shown) may be used to engage and move the cover 10/container 12. In this regard, because the head piece 36 (FIG. 2A) and the handle piece 38 (FIG. 2A) are connected to the face member 42 (FIG. 2A) by at least one of the plurality of breakable tabs 40 (FIG. 2A) at the respective ends, contacting the cover 10 with a suction cup will not cause the head piece 36 or the handle piece 38 to deflect away from the face member 38 by an appreciable distance. Similarly, because the protective film 30 is uniformly scaled to the face member 42, contact by a suction cup or similar device will not cause the protective film to peel away. Notably, where a number of similar products are stacked on top of the cover 10/container 12, these same attributes will minimize the potential for defect.

Figure 4:
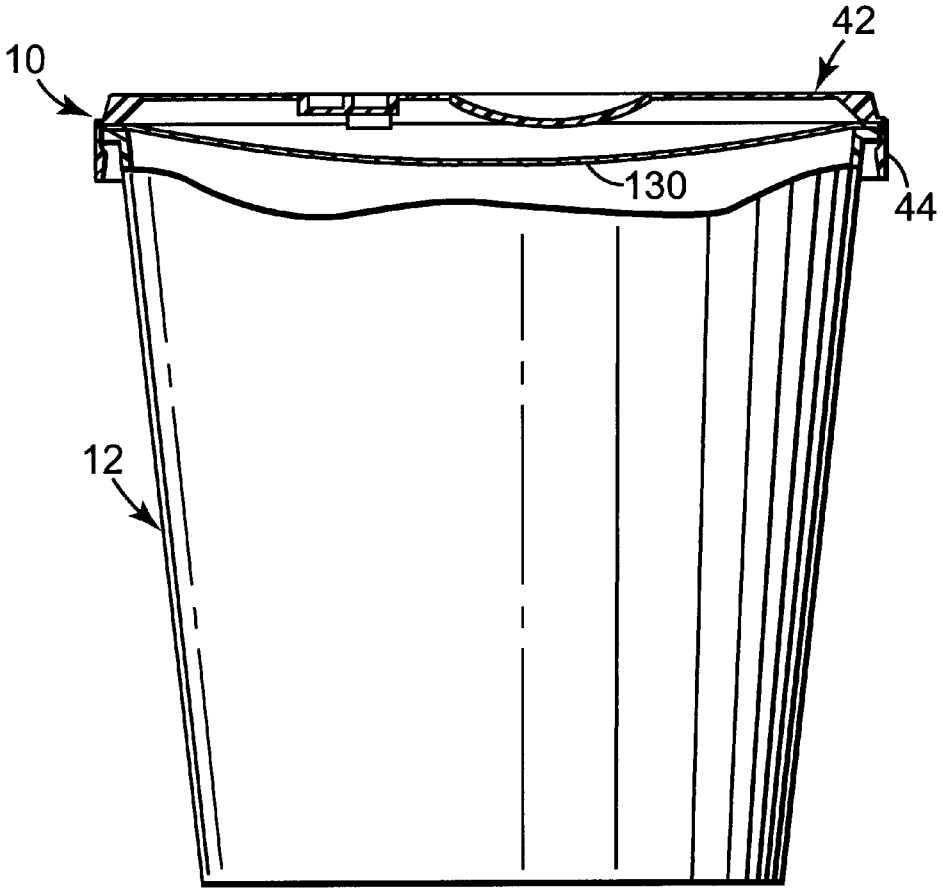
FIG. 4 is a cross-sectional view of the cover in accordance with the present invention, assembled to a portable food container.

As shown in FIG. 4, the container 12 may include a partition 130 scaling the contents of the container 12. For example, the partition 130 may be a foil material. Use of the foil partition 130 to seal the contents of the container 12 is a widely accepted practice. Optionally, foil partition 130 can be fabricated to include a tab feature (not shown) to facilitate its removal. While the foil partition 130 is impermeable to environmental contaminants, it may be possible to unexpectedly pierce the foil partition 130 with a relatively sharp object. Obviously, any defect imparted into the foil partition 130 will expose the contents of the container 12 to contaminants, potentially rendering the contents inedible. Notably, the foil partition 130 is normally not flexible, but is secured to the container 12 so as to have a slight slack. Thus, the foil partition 130 can deflect slightly either downwardly or upwardly. With this in mind, the closer the outside force is to an outer edge of the foil partition 130, the more likely it is that the force will pierce the foil partition 130.

Figure 5:
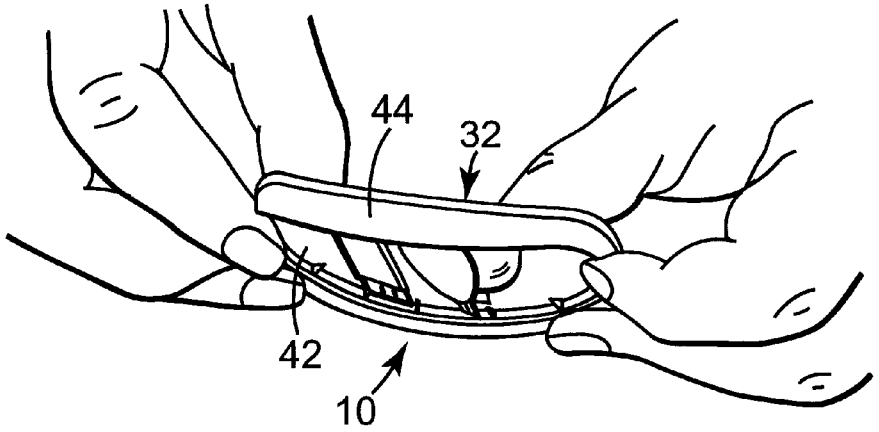
FIG. 5 is a perspective view of the cover in accordance with the present invention in a deflected state.

In light of the above concern, the cover 10 is preferably configured to minimize the potential of puncturing of the foil partition 130. More particularly, the posts 112 of the handle piece 38 present the most likely puncture-causing surface. With reference to FIGS. 2B and 5, the handle piece 38 is orientated relative to the face member 42 such that the posts 112 are as close to a center of the face member 42 as possible. With this more central location, the opportunity for the posts 112 to unexpectedly puncture the foil partition 130 in response to a downward force placed upon the cover 10 (such as by the machine arm (not shown) or when another container (not shown) is stacked on top of the cover 10) is greatly diminished.

With the cover 10 assembled to the container 12, the entire product is available for use by a consumer (not shown). The consumer removes the cover 10 from the container 12. The head piece 36 and the handle piece 38 are then detached from the cover body 32. To this end and with reference to FIGS. 2A and 5, the cover body 32 is preferably sufficiently flexible such that the breakable tabs 40 adjacent the leading end 74 of the head piece 36 and the trailing end 106 of the handle piece 38 are broken via a bending force focused on the cover body 32 adjacent the leading end 74 of the head piece 36. For example, as shown in FIG. 5, the cover body 32 has been bent or flexed upwardly. To accomplish this effect, the consumer may grasp the cover body 32 such that the consumer's thumb is placed in the middle of the face member 42, with the consumer's fingers grasping the skirt 44 adjacent the leading end 74 of the head piece 36. With this technique, the consumer's thumb serves as a pivot point about which the cover body 32 is bent. As the cover body 32 is maneuvered through this bending motion, the breakable tab 40*a* adjacent the leading end 74 of the head piece 36 and the breakable tab 40*d* adjacent the trailing end 106 of the handle piece 38 are severed such that the leading end 74 of the head piece 36 and the trailing end 106 of the handle piece 38 can easily be grasped apart from the cover body 32. The remaining tabs 40 are then broken by pulling the head piece 36 and the handle piece 38 away from the cover body 32. It should be noted that in a preferred embodiment, the protective film 30 (FIG. 1) need not be removed from the cover body 32 for detachment of the head piece 36 and the handle piece 38. In practice, however, the flexing motion may cause a portion of the protective film 30 to disengage or otherwise peel away from the cover body 32.

Figure 6:
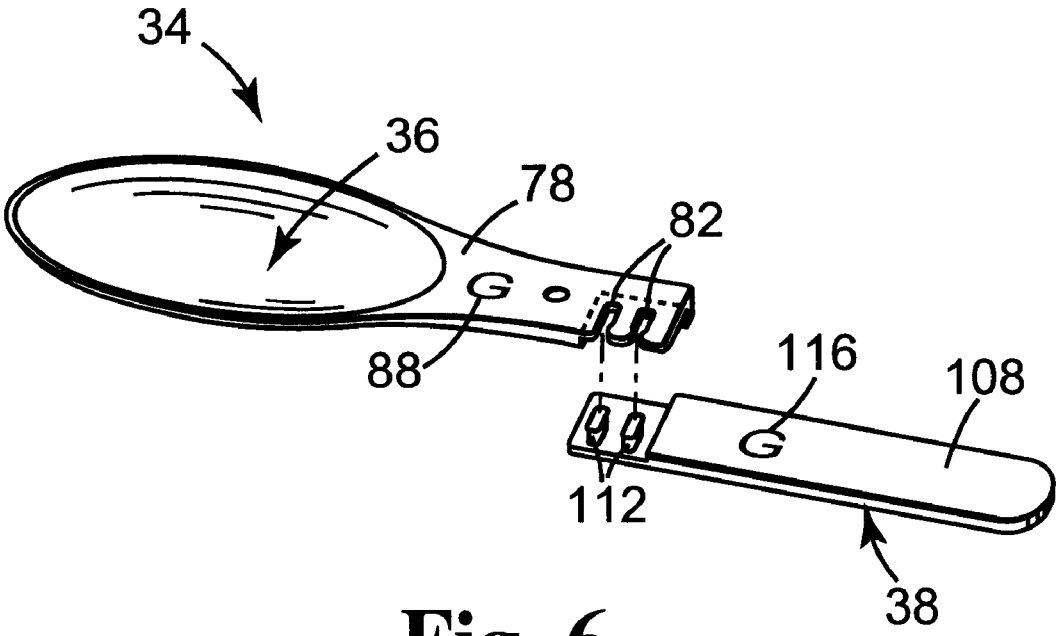
FIG. 6 is a perspective, exploded view of a spoon detached from the cover.

Once detached from the cover body 32, the head piece 36 and the handle piece 38 are assembled to form the utensil 34, for example a spoon, as shown in FIG. 6. In the preferred embodiment, the head piece 36 is maneuvered in vertical fashion toward the handle piece 38 such that the pair of posts 112 are engaged within the pair of slots 82, respectively. Notably, it may be possible for a consumer to mistakenly assemble the head piece 36 to the handle piece 38 such that the head piece 36 is "upside down". To this end, the indicia 88 in the head piece 36 and the indicia 116 in the handle piece 38 are provided to facilitate proper orientation of the head piece 36 relative to the handle piece 38. For example, where the indicia 88 and the indicia 1116 are identical trademarks, a consumer is more likely to orientate the head piece 36 and the handle piece 38 such that these trademarks are aligned. Alternatively, the indicia 88 and the indicia 116 may provide directional language to facilitate proper orientation.

Figure 7:
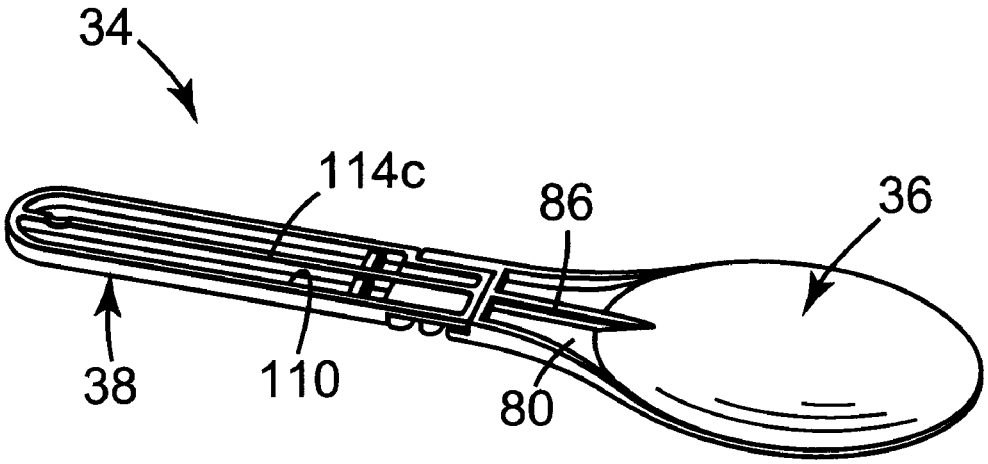
FIG. 7 is a bottom, perspective view of the assembled spoon of FIG. 6.

In addition to the indicia 88, 116 on the top surfaces 78, 108 of the head piece 36 and the handle piece 38, respectively, the head piece 36 and the handle piece 38 may include additional directional indicators. For example, in the assembled position shown in FIG. 7, the reinforcement 86 of the head piece 36 aligns with the centrally disposed rib 114*c* of the handle piece 38. Once again, by locating the reinforcement 86 on the bottom surface 80 of the head piece 36 and the central rib 114*c* on the bottom surface 110 of the handle piece 38, the consumer is given a clear, visual or tactile indication of proper assembly orientation.

Figure 8:
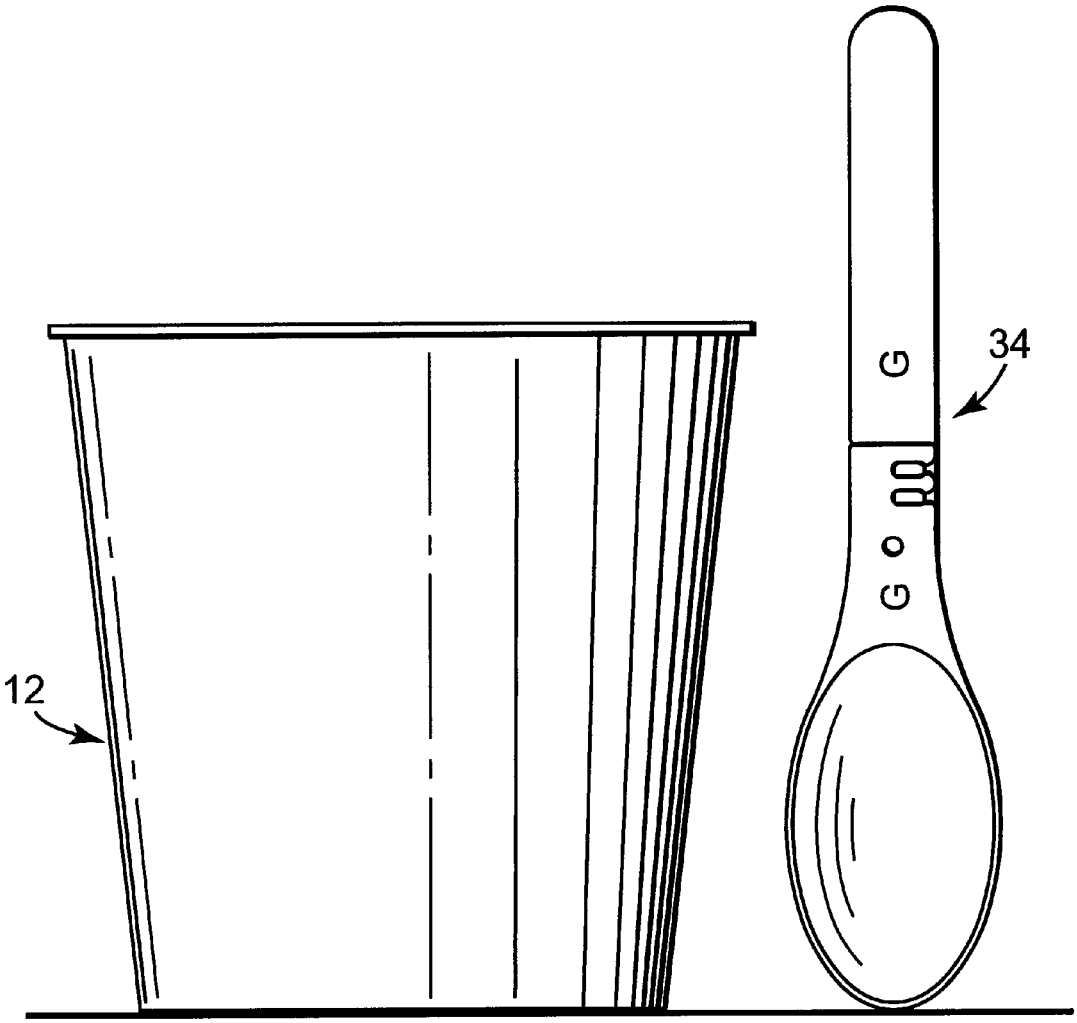
FIG. 8 is a side, elevational view of the assembled spoon of FIG. 6 and a portable food container.

Once assembled, the utensil 34 has a total length at least slightly greater than a depth of the container 12 as depicted in FIG. 8. It is highly likely that for the overall product configuration to be successful, the consumer (not shown) must be able to reach the bottom of the container 12 with the utensil 34 without the consumer's fingers contacting the contents of the container 12. For example, where the container 12 maintains a food item that requires stirring prior to consumption, such as a yogurt product with fruit on the bottom, the consumer will likely desire the ability to reach the bottom of the container 12 with the utensil 34. Thus, in one preferred embodiment, the spoon 34 has an overall length at least 5 millimeters greater than a depth of the container 12.

Following consumption, the consumer may recycle or otherwise discard the utensil 34 and the container 12. Where the contents of the container 12 are only partially consumed, however, the consumer may wish to store the remaining contents of the container 12 for future consumption. It will be recalled that during detachment of the head piece 36 and/or the handle piece 38, a portion of the protective film 30 (FIG. 1) may disengage or peel away from the cover body 32 (FIG. 1). In this regard, the protective film 30 can be resealed to the cover body 32. The cover body 32 is then secured to the container 12. Notably, the protective film 30 prevents contaminants from potentially contacting the contents of the container 12 via the head opening 54 (FIG. 2A) and/or the handle opening 36 (FIG. 2A).

The cover of the present invention provides a marked improvement over previous designs. First, the cover includes a detachable utensil to facilitate convenient consumption of food maintained by a portable food container associated with the cover. To this end, the utensil, and in particular the handle portion, is reinforced so as to limit longitudinal bending thereof. Where the reinforcement is a longitudinally extending rib, the overall material thickness of the handle can be greatly reduced, thereby reducing costs. A further savings is realized by utilizing a plastic injection manufacturing technique in which four gates are incorporated. Additionally, by connecting the utensil components to the cover with breakable tabs located along the entire periphery of each component including their ends, the cover itself will have sufficient structural integrity for processing through various manufacture, packaging, and storage steps. Finally, by incorporating a pressure sensitive adhesive, a protective film otherwise associated with the cover can be repeatedly removed and resealed to the cover.

Although the present invention has been described with reference to preferred embodiments, workers skilled in the art will recognize that changes may be made in form and detail without departing from the spirit and scope of the present invention. For example, the head piece and the handle piece have been described as being coupled via a dual post and slot configuration. Alternatively, any other coupling approach is equally acceptable. Similarly, the cover has been shown as including a detachable spoon. Alternatively, any other type of eating utensil, such as a fork, spork, knife, spatula (for spreading a frosting, jam or jelly or soft cheese, for example), etc., can be formed.

A number of attributes have been ascribed to one preferred embodiment the cover of the present invention. However, one or more of these features may be eliminated, yet the resulting cover still perform. For example, the handle piece and the head piece have been preferably described as including directional indicia for facilitating proper orientation in a assembled utensil position. These indicia are not necessarily required. Similarly, the protective film need not necessarily be resealably connected to the cover body. Along these same lines, an upwardly extending shoulder may be provided to receive the protective film.

What is claimed is:

1. A cover for a portable food container having a base and a side wall terminating in a lip opposite the base, the cover comprising:

a cover body configured to selectively receive the lip; and a utensil comprising:

a head piece detachably secured to the cover body, a handle piece detachably secured to the cover body, at least a portion of the handle piece including a plurality of ribs for limiting longitudinal bending thereof, the plurality of ribs including a substantially centrally located longitudinal rib that has a substantially planar bottom and a cross-rib extending perpendicular to, and intersecting with, the centrally located longitudinal rib;

wherein the head piece and the handle piece are configured for assembly to each other upon detachment from the cover body to form the utensil in an assembled position.

2. The cover of claim 1, wherein the head piece includes a bowl such that the utensil is a spoon.

3. The cover of claim 1, wherein at least one of the plurality of ribs extends from a base portion and has a height greater than a height of the base portion.

4. The cover of claim 1, wherein the handle piece includes a base portion to which the plurality of ribs are attached, and further wherein the plurality of ribs includes first and second ribs positioned at opposing sides of the base portion.

5. The cover of claim 4, wherein the head piece includes a neck extending from a food retaining means, the cover further comprising:

a longitudinally extending rib substantially centrally positioned along the neck for limiting longitudinal bending thereof.

6. The cover of claim 5, wherein the substantially centrally positioned rib associated with the neck aligns with the substantially centrally located rib of the handle piece in the assembled position.

7. The cover of claim 1 further comprising:

indicia disposed on at least the handle piece for designating proper orientation of the handle piece relative to the head piece in the assembled position.

8. The cover of claim 7, wherein the handle piece and the head piece each define a top and a bottom such that in the assembled position, the top of the head piece is substantially contiguous with the top of the handle piece, the indicia being inscribed on the top of the handle piece.

9. The cover of claim 7, wherein the handle piece and the head piece each include a top and a bottom such that in the assembled position, the bottom of the head piece is substantially contiguous with the bottom of the handle piece, the indicia comprising the substantially centrally located longitudinal rib on the bottom of the handle piece and a substantially centrally located longitudinal rib on the bottom of the head piece, the substantially centrally located ribs aligning with one another in the assembled position.

10. The cover of claim 1, wherein the side wall defines an internal depth of the portable food container, and further wherein the handle piece and the head piece are sized such that in the assembled position, the utensil has a length greater than the internal depth.

11. The cover of claim 1, wherein the head piece includes a neck extending from a bowl, the neck having a length greater than one-third a length of the bowl.

12. A cover for a portable food container including a base and a side wall terminating in a lip opposite the base, the cover comprising:

a cover body including:

a planar face member forming a head opening and a handle opening, a skirt extending downwardly from an outer periphery of the face member such that the face member defines an upper most plane of the cover body, the skirt sized to selectively receive the lip;

a utensil including:

a head piece disposed within the head opening, the head piece defining a leading end and a trailing end, a handle piece disposed within the handle opening, the handle piece defining a leading end and a trailing end, at least a portion of the handle piece including a longitudinal rib and a cross-rib for limiting longitudinal bending thereof;

a plurality of breakable tabs detachably securing the head piece and the handle piece to the face member, wherein the leading end and the trailing end of the head piece and the handle piece, respectively, are each directly connected to the face member by at least a respective one of the plurality of tabs;

wherein the head piece and the handle piece are configured for assembly to each other upon detachment from the face member to form the utensil;

a plurality of gate markings indicative of a plurality of plastic injection gates; and a protective film resealably secured directly to the planar face member.

* * * * *